US009737779B2

(12) United States Patent
Watson

(10) Patent No.: US 9,737,779 B2
(45) **Date of Patent: *Aug. 22, 2017**

(54) GOLF SWING PLANE TRAINING AID DEVICE

(71) Applicant: Edward Bates Watson, Dana Point, CA (US)

(72) Inventor: Edward Bates Watson, Dana Point, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/353,498

(22) Filed: Nov. 16, 2016

(65) Prior Publication Data

US 2017/0189776 A1 Jul. 6, 2017

Related U.S. Application Data

(63) Continuation of application No. 14/988,295, filed on Jan. 5, 2016, now Pat. No. 9,533,211.

(51) Int. Cl.
*A63B 69/36* (2006.01)
*A63B 69/00* (2006.01)

(52) U.S. Cl.
CPC .. *A63B 69/0059* (2013.01); *A63B 2208/0204* (2013.01)

(58) Field of Classification Search
USPC ..... 473/206, 212, 213, 214, 227, 257, 276
See application file for complete search history.

(56) References Cited

U.S. PATENT DOCUMENTS

| | | | | |
|---|---|---|---|---|
| 5,839,968 | A * | 11/1998 | Latella | A63B 69/0057 273/DIG. 20 |
| 5,904,624 | A * | 5/1999 | Martinez | A63B 69/3685 273/DIG. 30 |
| 7,758,437 | B1 * | 7/2010 | Stewart | A63B 69/3608 473/212 |
| 7,976,398 | B2 * | 7/2011 | Clawson | A63B 69/0059 473/212 |
| 9,533,211 | B1 * | 1/2017 | Watson | A63B 69/3608 |
| 2008/0119299 | A1 * | 5/2008 | Merrill | A63B 69/0057 473/212 |

* cited by examiner

*Primary Examiner* — Nini Legesse

(57) ABSTRACT

A golf swing plane training aid device for use with a golf club is presented. The training aid device includes an ellipsoid shaped body having two reference endpoints and two forearm guides adapted to fit forearms of a golfer. The golf training aid device provides a visual reference and aids the forearms of the golfer in the proper swing position along the swing plane and a target line by guiding the forearms and using the reference endpoints as visual feedback aid to determine point of reference along the target line.

8 Claims, 22 Drawing Sheets

GOLF SWING PLANE TRAINING AID DEVICE

RELATED APPLICATION

This application is a continuation of U.S. patent application Ser. No. 14/988,295, filed Jan. 5, 2016. Priority is hereby claimed to the above-identified Application, which is all incorporated by reference as if set forth fully herein.

FIELD OF THE INVENTION

The present invention relates to a golf training aid device used for the golfing industry. In particular, the present invention relates to a golf training aid having an ellipsoid shaped body with forearm guides and visual feedback references for training a golfer the proper golf swing of a golf club along a desired swing plane.

BACKGROUND

Several conventional golf training aid devices exist for helping a golfer improve their golf swing, thereby improving the stability and accuracy of the golfer's swing. Some of these training aid devices are designed to be attached to club grips of golf clubs, while other devices may be worn by the golfer.

Among other golf grip and swing techniques, a golf swing takeaway may be one of the key elements of the swing that can ruin the rest of the motion if not executed properly. Most beginner golfers are generally prone to make mistake in the golf swing takeaway that may lead to further swing plane errors in the backswing, resulting and adversely affecting downswing stroke and further contributing to impact problems.

Although many golf training devices aid in improving posture and swing alignment, other devices may be beneficial for reducing swing plane errors in the backswing and downswing.

SUMMARY

It is an advantage of the present invention to provide a golf training aid device for providing visual references and encourages the right arm and shoulder for a right-handed golfer, for example, to externally rotate, guiding the forearms of a golfer to a predetermined swing plane. The golf training aid device comprising an ellipsoid shaped body having a surface, a first end, a second end opposite to the first end, a first side, a second side opposite to the first side, a first circumference, and a second circumference having a radius less than a radius of the first circumference, a first reference endpoint defined on the first end of the ellipsoid shaped body, a second reference endpoint defined on the second end of the ellipsoid shaped body, a first forearm guide defined on the surface of the first side of the ellipsoid shaped body, and a second forearm guide defined on the surface of the second side of the ellipsoid shaped body, wherein the first forearm guide includes a first tapered-shaped cavity defined on the first side of the ellipsoid shaped body and the second forearm guide has a second tapered-shaped cavity defined on the second side of the ellipsoid shaped body.

It is another advantage of the present invention to provide one or more hook and loop strips coupled to the first forearm guide and the second forearm guide.

It is yet another advantage of the present invention to provide a first pad coupled to the first forearm guide and a second pad coupled to the second forearm guide for increasing the width to fit multiple forearms of various sizes and shapes.

It is no less another advantage of the present invention to provide the golf training aid device that is configured to ergonomically fit in between the forearms of the golfer, having dimensions and weight specifications that do not hamper or impede with the natural swing of the golfer.

In another aspect, the ellipsoid shaped body of the golf training aid device is defined by a housing structure having a hollow interior.

In yet another aspect, the first forearm guide is supported by a first inner portion of the right forearm of the golfer and the second forearm guide is supported by a second inner portion of the left forearm of the golfer.

In still yet another aspect, the first forearm guide is rotated at a first tilt angle and the second forearm guide is rotated at a second tilt angle. Both tilt angles have predetermined angles for keeping the swing of the golf club substantially along a predetermined swing plane, providing an ergonomically designed fit with the forearms of the golfer.

In another aspect, the first tilt angle and the tilt angles are substantially oblique angles to maintain a proper swing plane position relative to the visual references.

In another aspect, the first reference endpoint is configured to aim at the golfer and the second reference endpoint is configured to aim at a target line.

In another embodiment, the first and second reference endpoints provide a visual reference for directing a golf club along the predetermined swing path.

In yet another embodiment, the predetermined swing path is defined along a trajectory of the golf club having a clubface having a leading edge that is substantially perpendicular to a golf ball and a target line for achieving a substantially centered impact.

In still yet another embodiment, a first fastener coupled the first reference endpoint and a second fastener coupled the second reference endpoint.

In some embodiments, the first fastener and the second fastener are adapted to receive an extension member.

In another embodiment, the ellipsoid shaped body has a first section and a second section, wherein the first section is detachable from the second section by a fastening mechanism.

In yet another embodiment, the ellipsoid shaped body includes a detachable lid for accessing the hollow interior of the golf training aid device.

In still yet another embodiment, a flexible membrane is applied over the on the housing structure of the ellipsoid shaped body, providing comfort and support to the forearms of the golfer.

In some aspects, the golf training aid device may include a laser guided circuit defined within the hollow interior of the ellipsoid shaped body, wherein the laser guided circuitry includes a spot laser for projecting a first visual reference light at the golfer and a target laser for projecting a second visual reference light at the target line.

These and other objects, features and advantages of the present invention will become more apparent in light of the following detailed description of preferred embodiments thereof, as illustrated in the accompanying drawings.

BRIEF DESCRIPTION OF THE DRAWINGS

The present invention will be more clearly understood from the following detailed description of the preferred embodiments of the invention and from the attached drawings, in which.

In the appended figures, one or more elements may have the same reference numeral in different figures indicating previously described elements.

DETAILED DESCRIPTION

Properly orientating and positioning a golf club can be challenging and difficult for many golfers. In a typical golf club design, the main parts of the golf club include a grip, a shaft, and a head. The head of the golf club has two sides known as a clubface and a back. In practice, the ideal is to get the leading edge of the clubface to a golf ball and target line substantially perpendicular at impact. With respect to the clubface, it may be difficult to set the proper orientation of the clubface based on the golfer's forearm positioning and alignment at address and backswing positions.

Figure 1:
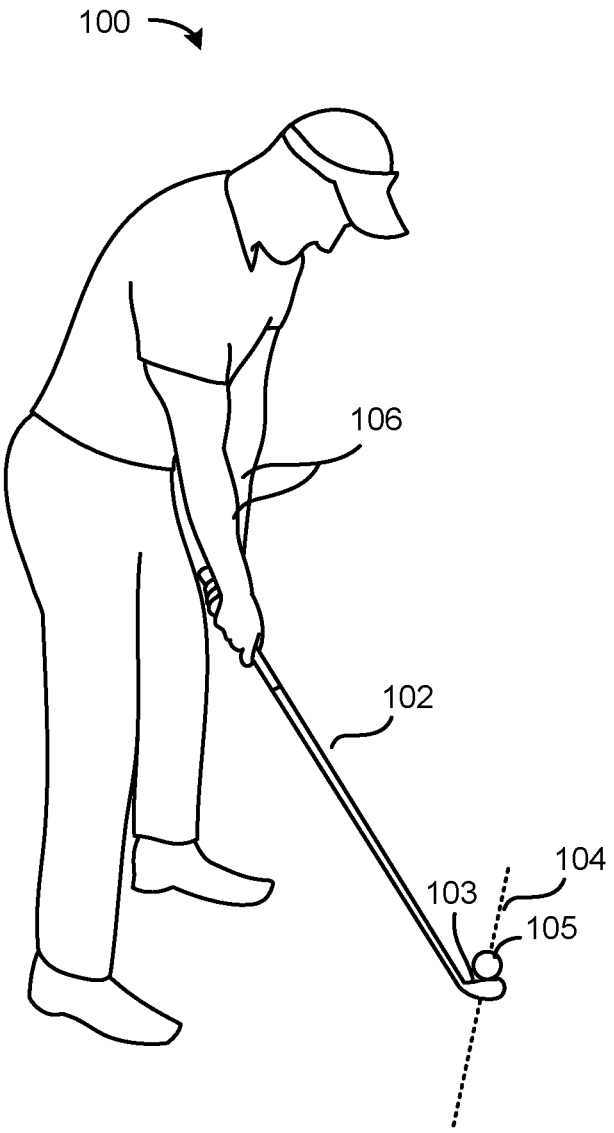
FIG. 1 illustrates a typical stance of a golfer with a golf club at address position.

FIG. 1 illustrates a golfer 100 with a golf club 102 at address or starting position. At address position, the leading edge of the clubface 103 of the golf club 102 positioned on an imaginary target line 104. A golf ball 105 is placed along the imaginary target line 104 so that the clubface of the golf club 102 is substantially perpendicular to the golf ball 105 prior to impact. In practice, the top of the grip of the golf club points directly at the golfer 100 while the clubface points directly at the target line 104. Improper club handling techniques can and often leads to inconsistent and ineffective golf swings at impact. For example, bending or improperly rotating the forearms while holding the golf club 102 may adversely affect the alignment and swing at impact. To avoid such improper swing techniques, during the initial part of the take away, the forearms 106 of the golfer should be generally straight and rotated so that the grip end points directly at the center line of the golfer and the clubface of the golf club points at and is perpendicular to the target line 104.

Figure 2:
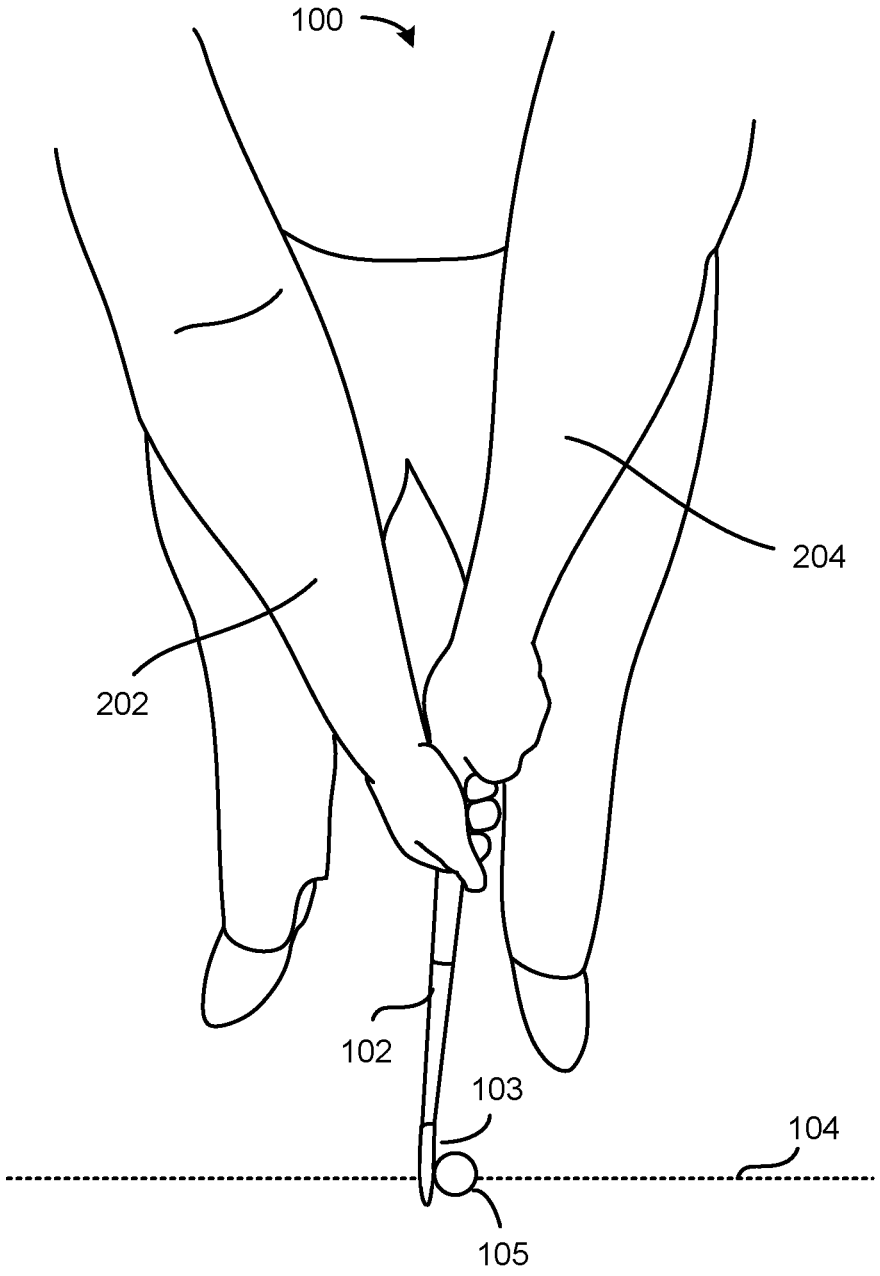
FIG. 2 further illustrates an exemplary positioning and stance of an inner portion of the right and left forearms of the golfer at address position.

FIG. 2 further illustrates the positioning of an inner portion of the right and left forearms (202, 204, respectively) of the golfer 100 to achieve the proper stance at address position. Both right and left forearms (202, 204) are shown to be straight along the golfer's torso and rotated so that the club face of the golf club 102 is perpendicular to the target line 104.

Figure 3:
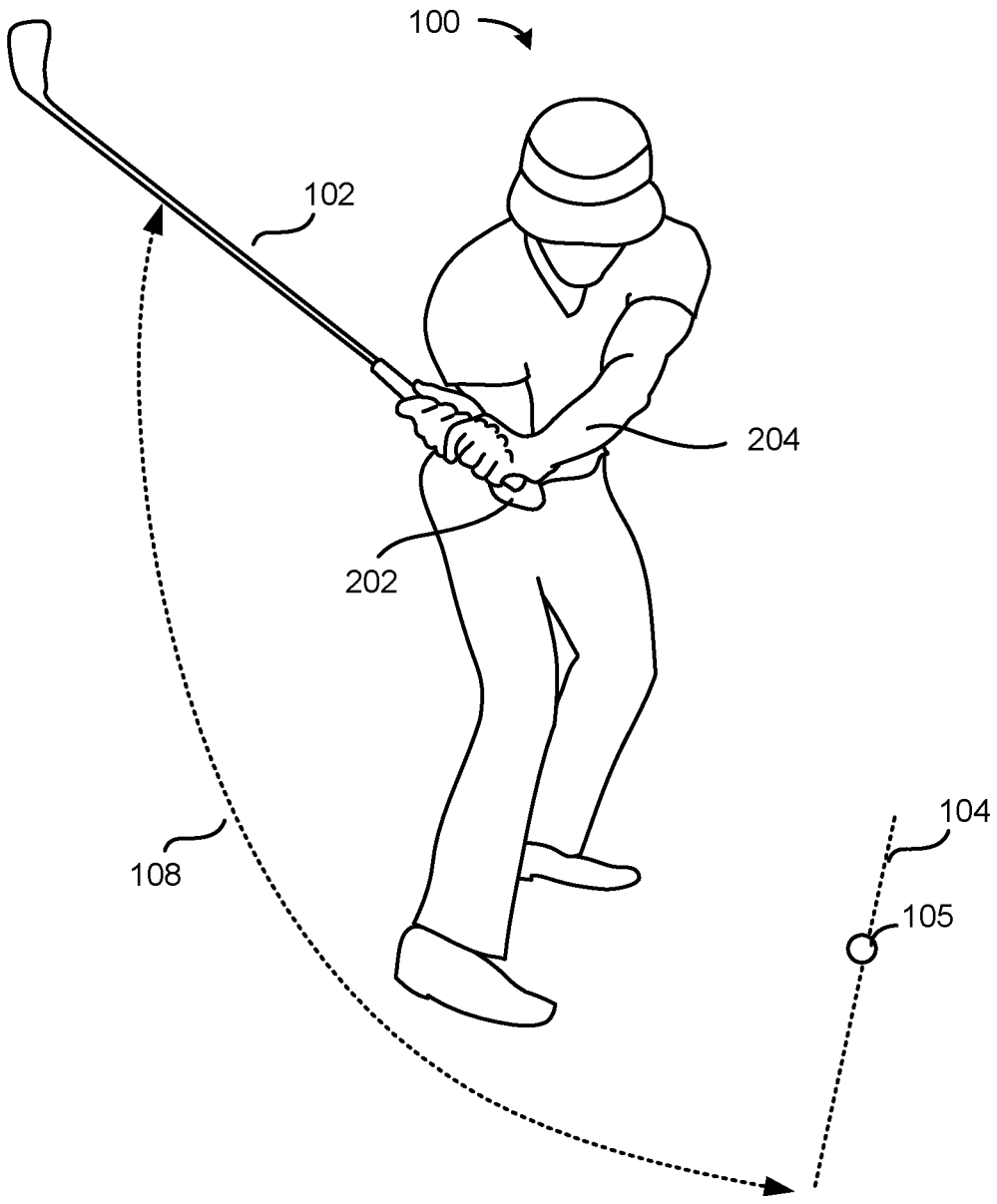
FIG. 3 illustrates a golf swing along an imaginary swing plane of the golfer.

FIG. 3 illustrates a golf swing along an imaginary swing plane 108 of the golfer 100. In this example, the target plane 104 is on the swing plane 108. The proper swing positioning is achieved when the golfer 100 keeps the swing of the golf club 102 along the swing plane 108 and ends the swing along the target line 104. Moreover, keeping the arms and hands along the center and in front of the body may provide the golfer a better strike and center hit, achieving greater distance on the golf ball.

Figure 4A:
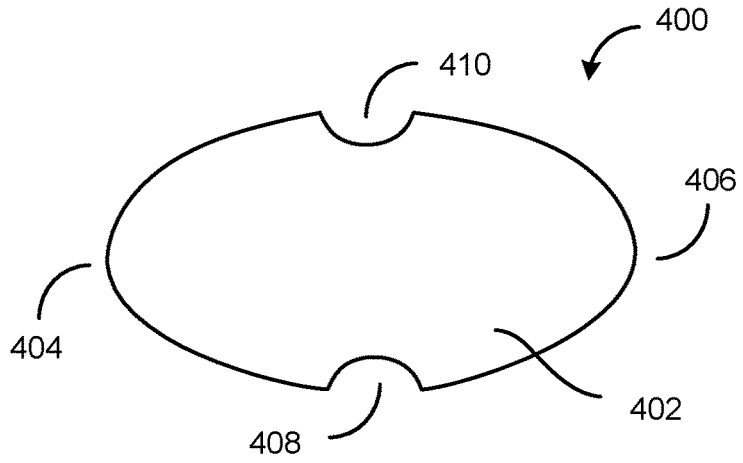
FIG. 4A illustrates a top view drawing of a golf training aid device, in accordance with an embodiment.

FIG. 4A illustrates a top view drawing of a golf training aid device 400 in a first embodiment of the present invention. In practice, the golf training aid device 400 is applied between the forearms of the golfer 100, providing visual and physical references for keeping the proper swing positioning of the golf club 102 along the swing plane 108 as discussed hereinabove. The golf training aid device 400 includes, for example, an ellipsoidal body 402 having a rear facing reference endpoint 404, a front reference endpoint 406 that is opposing or opposite to the rear reference endpoint 404, a right forearm swing guide 408 defined on the right side of the ellipsoidal body 402, and a left forearm swing guide 410 defined on the left side of the ellipsoidal body 402.

Figure 4B:
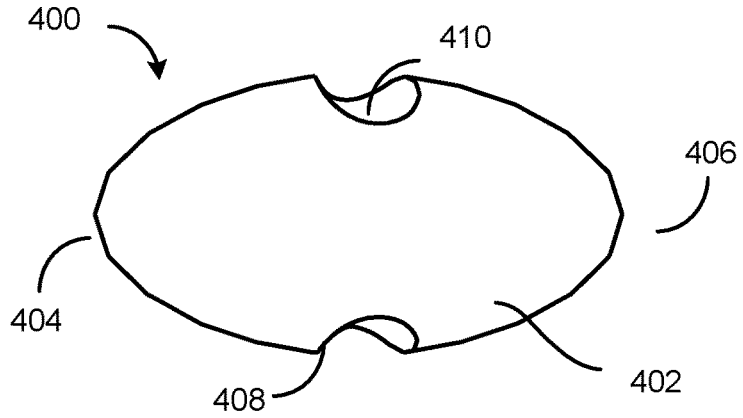
FIG. 4B illustrates a 3D perspective top view of the golf training aid device of FIG. 4A, in accordance with an embodiment.

FIG. 4B illustrates a 3D perspective top view of the golf training aid device 400 of FIG. 4A. This 3D rendered illustration further demonstrates the shading and depth of the ellipsoidal body 402 as seen from the top of the golf training aid device 400. The golf training aid device 400 is generally made to be durable and compact, yet it is also lightweight in order to provide comfort and fit with each forearm of the golfer 100. The ellipsoidal body 402 may be made from various materials such as plastic, foam, carbon-fiber, wood, or other lightweight composite materials. A tactile surface may be applied to the outer surface of the ellipsoidal body 402 to maintain a firm grip and contact with the forearms of the golfer. The right forearm swing guide 408 may be form-fitted to the right forearm of the golfer 100 and the left forearm swing guide 410 may be form-fitted to the left forearm of the golfer 100, providing ergonomic, comfort, and a snug fit with each forearm of the golfer.

Figure 4C:
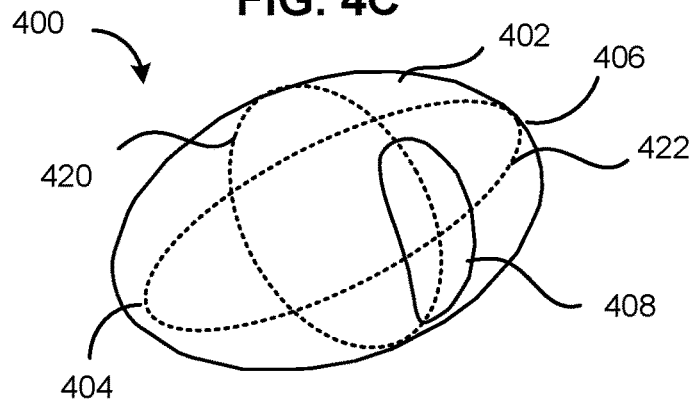
FIG. 4C illustrates a short and long circumferences of the golf training aid device as shown in a right 3D perspective view thereof.

FIG. 4C illustrates a right 3D perspective view of the golf training aid device 400. This 3D rendered illustration further demonstrates the ellipsoidal body 402 having a short circumference 420 defined along a mid-plane between the forearm swing guide (408, 410). The ellipsoidal body 402 may also have a long circumference 422 that is defined along a mid-section between the reference endpoints (404, 406). Moreover, because the golf training aid device 400 may be made to ergonomically fit between the forearms of the golfer, the typical dimensions and weight of the golf training aid device 400 may include the following specifications: a short circumference 420 at its widest point of approximately 15.0-25.0 inches; a long circumference 422 at its widest point of approximately 25.0-30.0 inches; a weight of approximately less than 5 pounds; and a length of approximately 5.0-12.0 inches long.

As seen in FIGS. 4A-4C, the body 402 of golf training aid device 400 may have an ellipsoidal shape as to provide the golfer 100 at least two points of references: the first point of reference being the rear facing endpoint 404; and the second point of reference being the front facing endpoint 406. The curved features of the ellipsoidal body 402 at each reference endpoint (404, 406) provide a visual reference for the golfer as to the direction each endpoint of the swing plane training aid device 400 is pointing. Further details and embodiments of the reference endpoints (404, 406) for use as visual references are discussed later in this document.

Figure 5A:
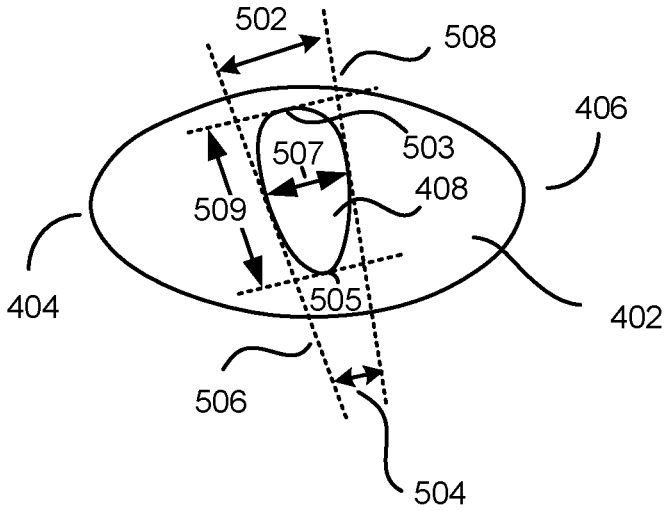
FIG. 5A illustrates a drawing of a right side view of the golf training aid device shown if FIG. 4A, in accordance with an embodiment.

FIG. 5A illustrates a drawing of a right side view of the golf training aid device 400 shown if FIG. 4A. As shown in this figure, the ellipsoidal body 402 includes a tapered-shaped cavity, like that of an oval, which defines the right forearm swing guide 408 area, having a width 507, a length 509 and tapered along lines 506 and 508. The tapered shape of the right forearm swing guide 408 area has a first width 502 at a first end 503 of the right forearm swing guide 408 and a second width 504 at a second end 505 of the right forearm swing guide 408. The first width 502 is defined to be greater than the second width 504 and the first end 503 of the right forearm swing guide 408 is opposite to the second end 505 of the right forearm swing guide 408. In practice, the tapered shape of the right forearm swing guide 408 area is made to fit the tapered shape of the inner portion of the right forearm of the golfer 100, providing comfort fit while handling the golf club at various stroke positions.

Figure 5B:
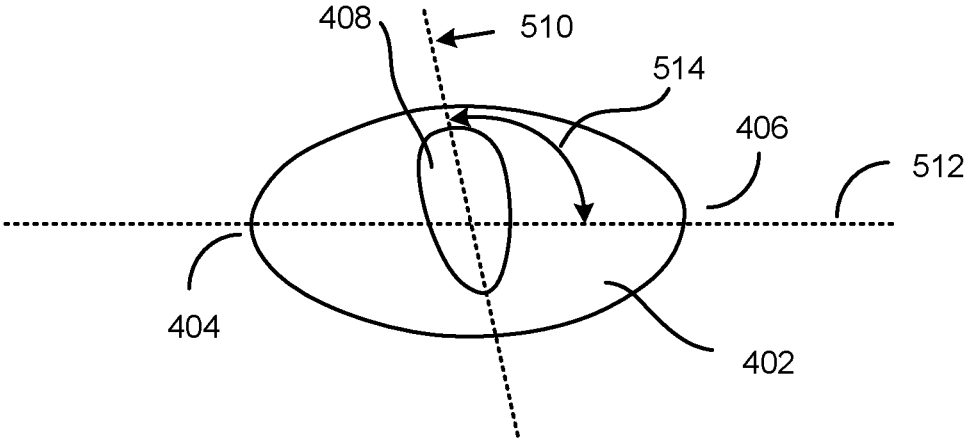
FIG. 5B illustrates the same right side view of the golf training aid device shown in FIG. 5A, in accordance with an embodiment.

FIG. 5B illustrates the same right side view of the golf training aid device 400 shown in FIG. 5A. Relative to a mid-section 512 defined along the rear and front endpoints (404, 406) of the golf training aid device 400, the right forearm swing guide 408 is rotated at a tilt angle 514. In this illustration, the tilt angle is defined as the angle between the mid-section 512 of the body 402 and a mid-section 510 of the right forearm swing guide 408. Moreover, relative to the rear and front reference endpoints (404, 406), the tilt angle 514 of the right forearm swing guide 408 is greater than 90 degrees, having an oblique angle. In practice, the tilt angle 514 is defined at an angle that aligns the golf training aid device 400 so that the rear reference endpoint 404 points directly at the golfer 100 while the front reference endpoint 406 points at or along the target line 104.

Figure 6A:
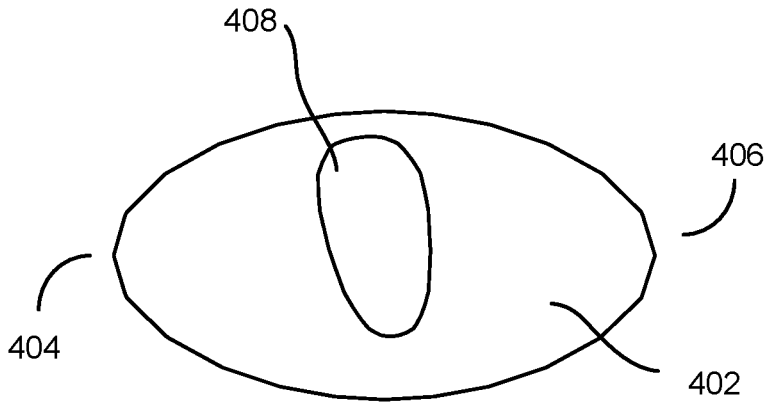
FIG. 6A illustrates a 3D perspective right side view of the golf training aid device of FIGS. 5A and 5B, in accordance with an embodiment.

FIG. 6A illustrates a 3D perspective right side view of the golf training aid device 400 of FIGS. 5A and 5B. This three-dimensional rendered illustration demonstrates the shading and depth of the right forearm swing guide 408 and the rear and front reference endpoints (404, 406) as seen from the right side of the golf training aid device 400. In this 3D illustration, a cavity or groove defined within the body 402 of the golf training aid device 400 is shown and further exemplifies the oval-shaped recessed trough of the right forearm swing guide 408. A negative mold or impression of the inner forearm of the golfer may be used to form the cavity that is defined on the surface of the body 402.

Figure 6B:
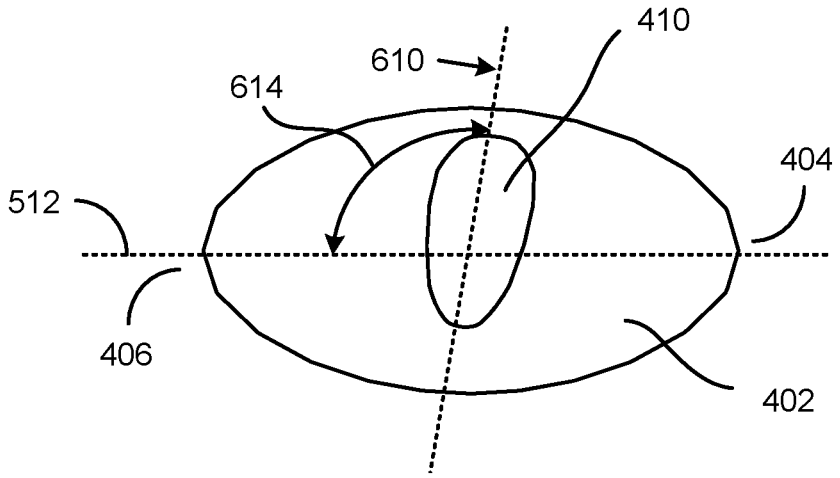
FIG. 6B illustrates a 3D perspective left side view of the golf training aid device, in accordance with an embodiment.

In FIG. 6B, a 3D perspective left side view of the golf training aid device 400 is illustrated. As shown in this figure, the ellipsoidal body 402 includes an oval-shaped recessed trough that defines a left forearm swing guide 410 area, having a tapered shape and dimension that is has similar or identical to the right forearm swing guide. Like the right forearm swing guide, the tapered shape of the left forearm swing guide 410 may be made to fit the tapered shape of the inner portion of the left forearm of the golfer 100, providing comfort fit while handling the golf club at various stroke positions.

In comparing FIG. 6A with FIG. 6B, note that the appearance of the right forearm swing guide 408 of the golf training aid device 400, is a mirror image of the left forearm swing guide 410. Relative to a mid-section 512 defined along the rear and front reference endpoints (404, 406) of the golf training aid device 400, the left forearm swing guide 410 is rotated at a tilt angle 614. In this illustration, the tilt angle is defined as the angle between the mid-section 512 of the body 402 and a mid-section 610 of the left forearm swing guide 410. Moreover, relative to the rear and front reference endpoints (404, 406), the tilt angle 614 of the left forearm swing guide 410 is similar or identical to the tilt angle 514 of the right forearm swing guide 408 (i.e., greater than 90 degrees or oblique angle). In practice, like the right forearm swing guide 408, the tilt angle 614 of the left forearm swing guide 410 is defined to be at an angle that aligns the golf training aid device 400 so that the rear reference endpoint 404 points directly at the golfer 100 while the front reference endpoint 406 points at or along the target line 104.

Figure 7A:
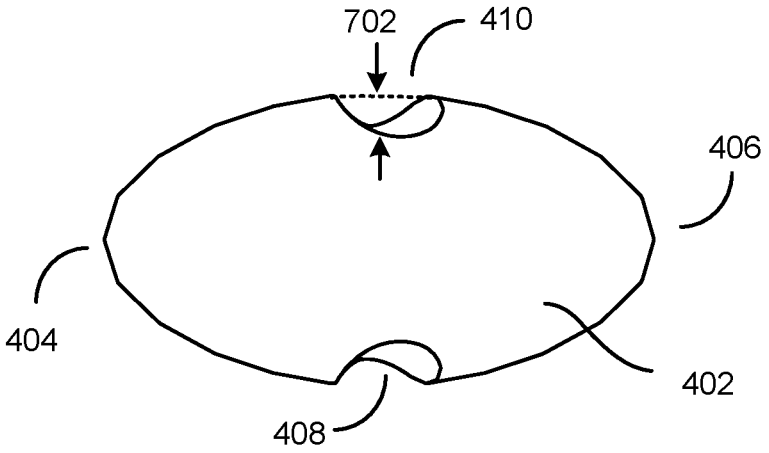
FIG. 7A illustrates a top 3D perspective view of the golf training aid device, in accordance with an embodiment.
Figure 7B:
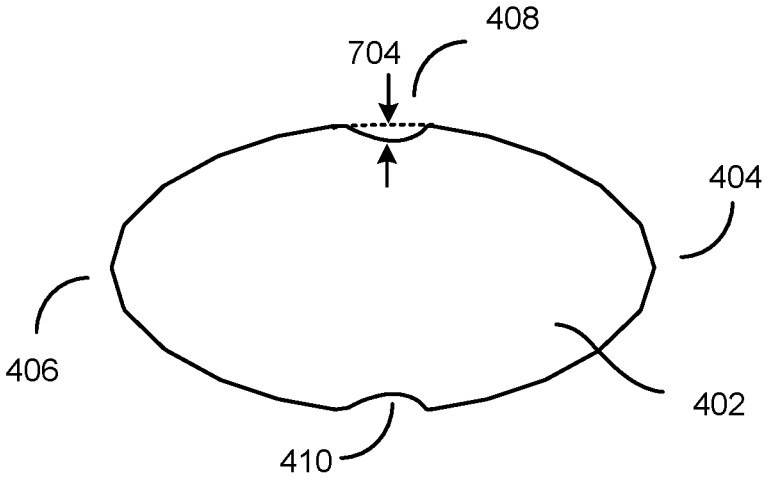
FIG. 7B illustrates a bottom 3D perspective view of the golf training aid device, in accordance with an embodiment.

Referring to FIG. 7A and FIG. 7B, top and bottom 3D perspective views of the golf training aid device 400 are illustrated, respectively. In FIG. 7A and FIG. 7B, troughs (grooves or cutouts) in the body 402 defining the right and left forearm swing guides (408, 410) are shown. Also shown in both figures are the rear and front reference endpoints (404, 406) which provided as points of references. Due to the tapered design of both the right and left forearm swing guides (408, 410), the differences in width and locations of the troughs is evident when comparing FIG. 7A to FIG. 7B. In other words, FIG. 7A demonstrates the trough of the right forearm swing guide 408 having a wide and deep depression depth 702 in contrast to the narrow and shallow depression depth 704 trough of the left forearm swing guide 410 seen in FIG. 7B. In such embodiments, the right and left forearm swing guides (408, 410) may be made to be ergonomically adapted to the forearms of the golfer, having, for example, the following dimensions: a width 507 of approximately 2.0-4.0 inches, a length 509 of approximately 3.0-6.0 inches, a short tapered width 504 of approximately 1.0-3.0 inches; a long tapered width 502 of approximately 2.0-5.0 inches; the tilt angle 514 of approximately greater than 90 degrees; and cavity depths (702, 704) of approximately 0.5-1.5 inches deep.

Figure 8A:
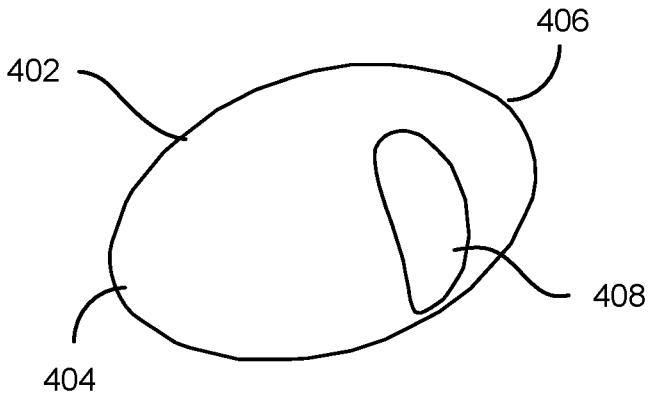
FIG. 8A illustrate a right 3D perspective view of the golf training aid device, in accordance with an embodiment.
Figure 8B:
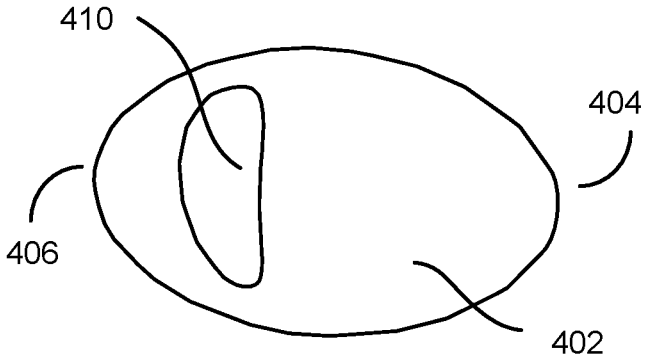
FIG. 8B illustrate a left 3D perspective view of the golf training aid device, in accordance with an embodiment.

FIG. 8A and FIG. 8B illustrate right and left 3D perspective views of the golf training aid device 400, respectively. These drawings further demonstrates the tapered design and cavities of the right and left forearm swing guides (408, 410) defined within the body 402 as seen from each side of the golf training aid device 400. Also shown in both figures are the rear and front reference endpoints (404, 406) which act as visual points of references to assist the golfer in determining the correct strike position.

Figure 9:
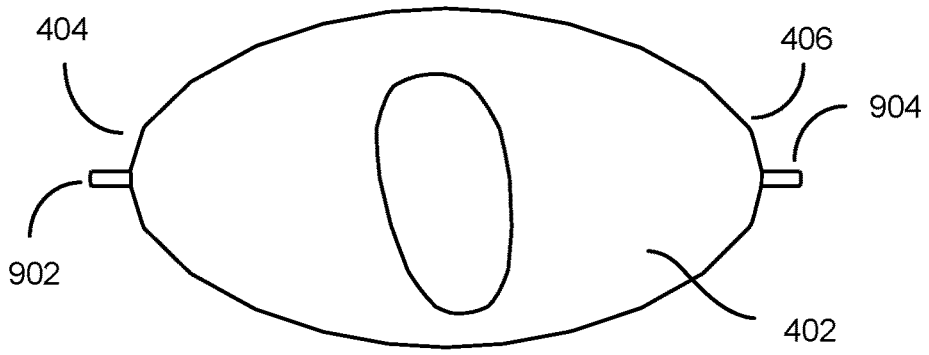
FIG. 9 illustrates reference rods coupled to the golf training aid device, in accordance with an embodiment.

FIG. 9 illustrates another embodiment of the present invention of the golf training aid device 400. In this embodiment, reference rods (902, 904) are coupled to the rear and front reference endpoints (404, 406), respectively. Each reference rods (902, 904) may act as visual pointer which may aid the golfer 100 to position and align the golf training aid device 400 at various positions and angles. Both reference rods (902, 904) may be further visually enhanced by applying various colors, sizes, or shapes.

Figure 10A:
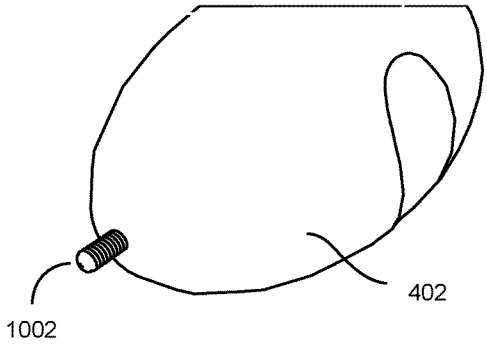
FIG. 10A illustrates a threaded bolt fastener applied to the golf training aid device, in accordance with an embodiment.
Figure 10B:
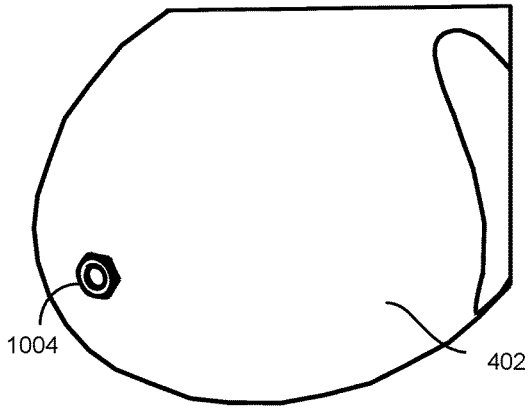
FIG. 10B illustrates a threaded nut fastener applied to the golf training aid device, in accordance with an embodiment.

FIG. 10A and FIG. 10B illustrates yet another embodiment of the present invention of the golf training aid device 400. In particular, the reference rods (902, 904) presented in the previous embodiment, may be configured as a threaded bolt 1002 as shown in FIG. 10A or configured as a threaded nut 1004 as shown in FIG. 10B. Like in the previous embodiment, the threaded bolt 1002, threaded nut 1004 or combination thereof may be coupled to the rear and front reference endpoints (404, 406). The threaded bolt 1002 or threaded nut 1004 may be designed to receive and couple to an extension rod (not shown) to aid in visually enhancing the visual pointer of the golf training aid device 400.

Figure 11A:
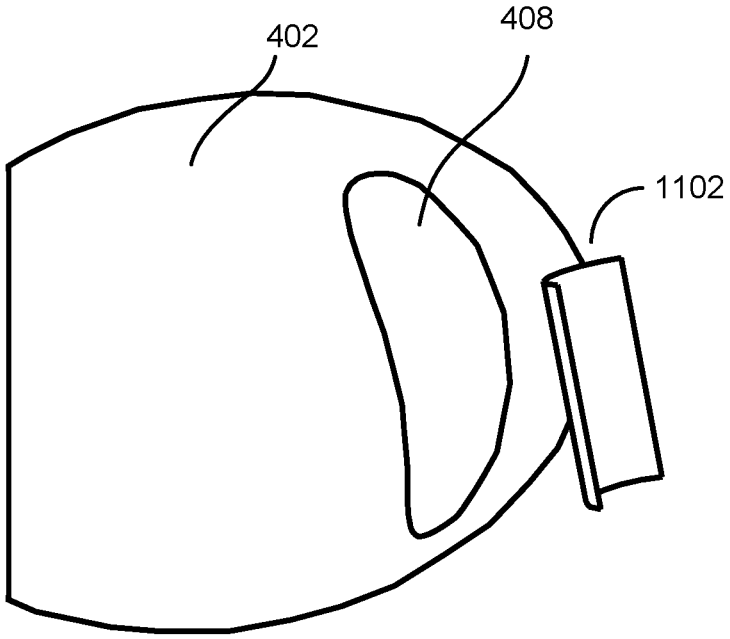
FIG. 11A and FIG. 11B illustrate a hook and loop strip may be attached to the golf training aid device, in accordance with an embodiment.
Figure 11B:
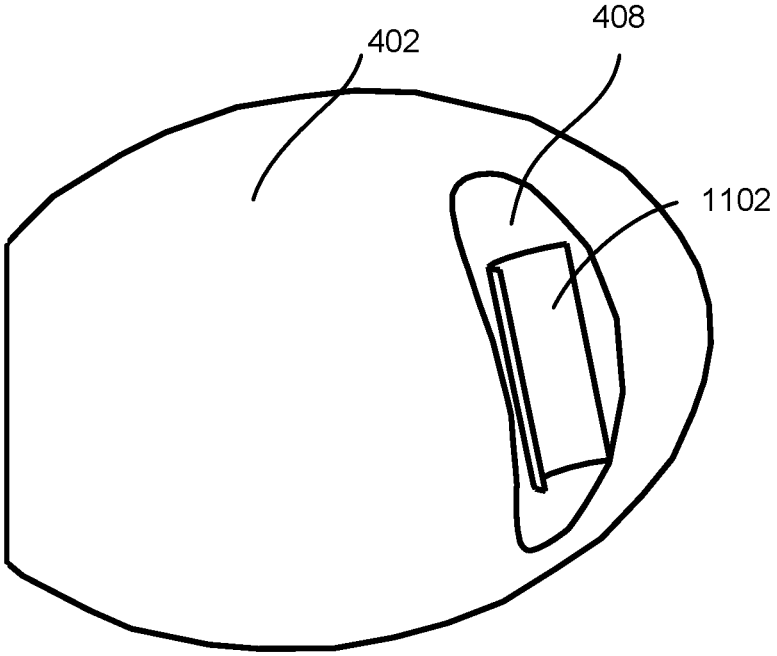

In accordance with another embodiment, the golf training aid device 400 described hereinabove may include attachment elements to secure the training aid device 400 to the forearms of the golfer 100. For example, as illustrated in FIG. 11A and FIG. 11B, a hook and loop strip 1102 may be attached to the surface of the forearm swing guides (408 and 410) using materials such as, for example, glue, tape, or fabric threads. In addition, the hook and loop strip 1102 may be made to fit the area of the forearm swing guides (408 and 410). As applied in practice, the size of the hook and loop strip 1102 may be approximately 1"-4" in width by 1"-5" in length.

Figure 12A:
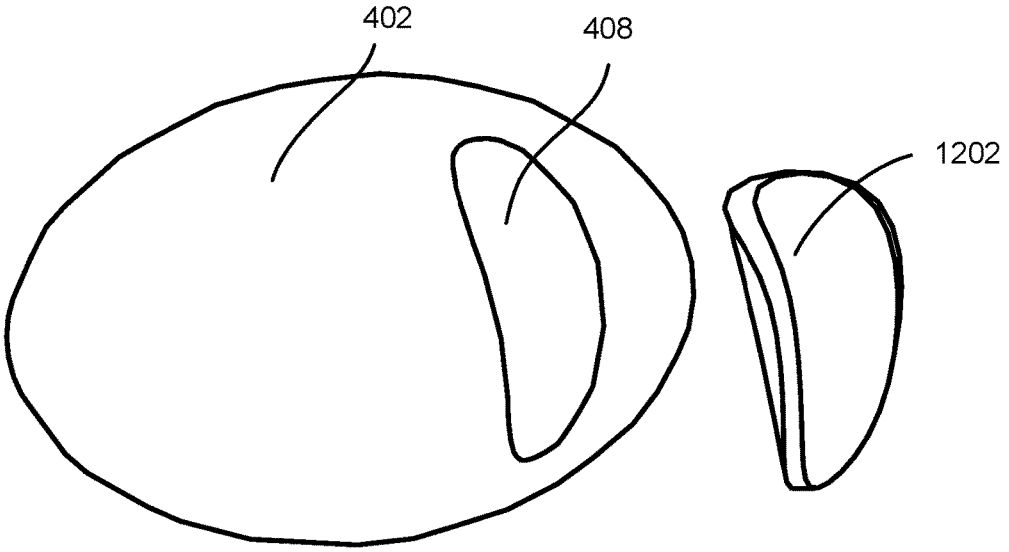
FIG. 12A and FIG. 12B illustrate a pad applied to the golf training aid device, in accordance with an embodiment.
Figure 12B:
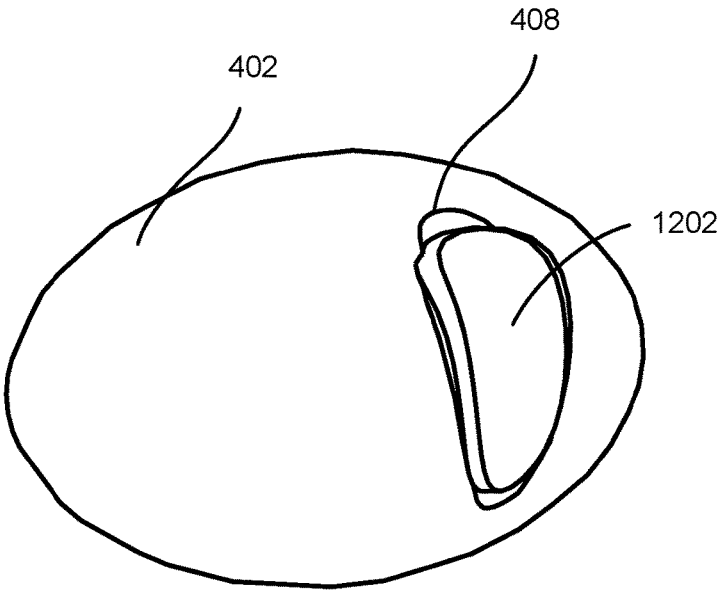
Figure 13:
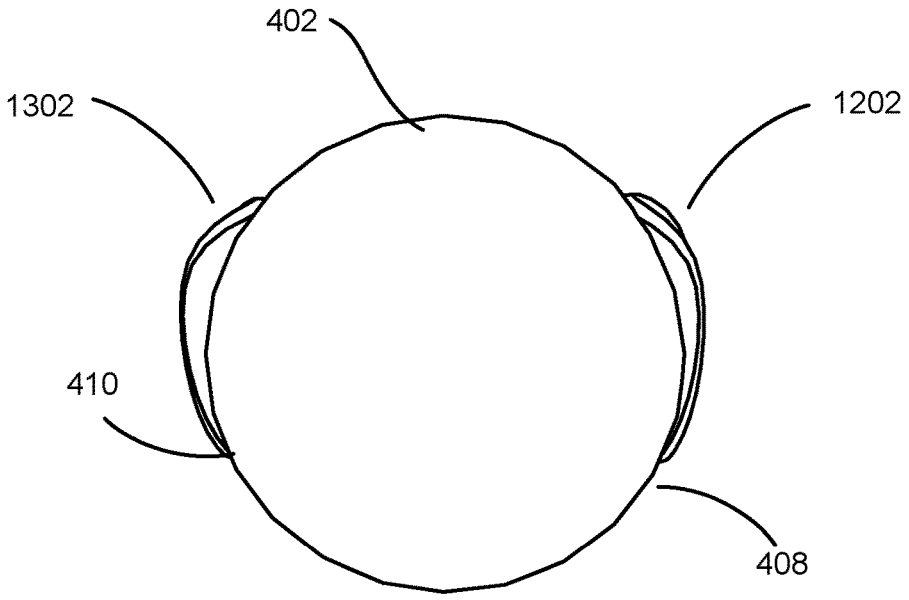
FIG. 13 illustrates a second pad applied to the golf training aid device, in accordance with an embodiment.

In yet another embodiment, the golf training aid device 400 described hereinabove may include padding to increase the girth or short circumference of the training aid device 400 to fit various forearm dimensions. FIG. 12A and FIG. 12B illustrate, for example, a pad 1202 that is form-fitted to the right forearm swing guide 408 having generally the same tapered shape, length and width thereof. As shown in a rear facing view of the golf training aid device 400 of FIG. 13, a second pad 1302 may also be applied to the left forearm swing guide 410. In this embodiment, the pads 1202 and 1302 may be attached the training aid device 400 using hook and loop strips 1102 described hereinabove or other mechanical fasteners such as clips, pins, spring loaded locks, and so on. In practice, these types of fasteners allow the pads 1202 and 1302 to be quickly detached or attached to the golf training aid device 400, allowing various fits to different forearms sizes of different golfers.

Figure 14A:
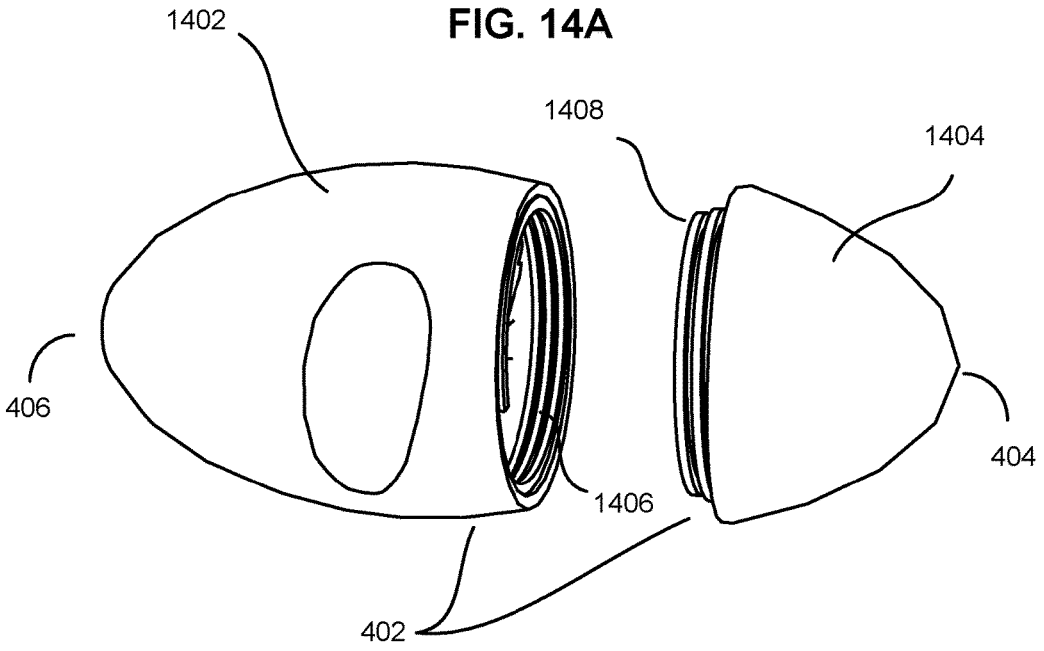
FIG. 14A illustrates the golf training aid device having a hollow interior and separable into two parts, in accordance with an embodiment.
Figure 14B:
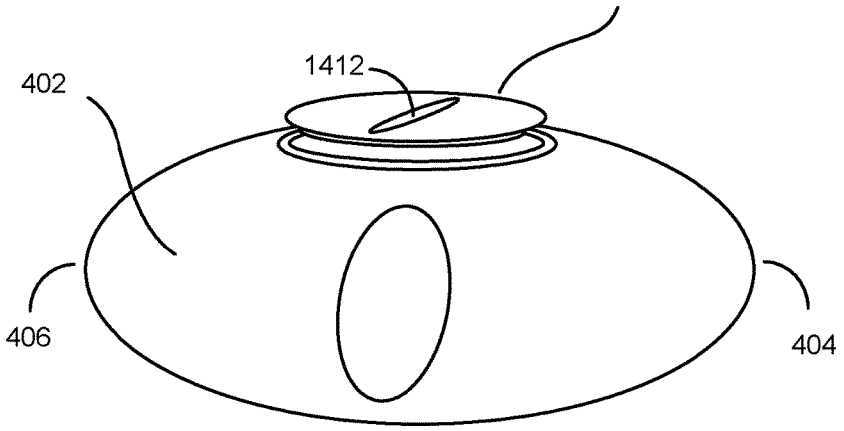
FIG. 14B illustrates the golf training aid device having a lid, in accordance with an embodiment.

In yet another embodiment, the body 402 of the golf training aid device 400 may be separated into two parts as shown in FIG. 14A and FIG. 14B. In FIG. 14A, for example, the interior of the body 402 is hollow and includes a first member 1402 and a second member 1404. Advantages of having the hollow interior of the body 402 includes but is not limited to a compact and light weight device, a carry case compartment for golf accessories, and added ability to include electronic circuitry for enhanced operation and features as described later herein below. The first member 1402 and second member 1404 may be coupled and decoupled by using a threaded type design. For example, the first member 1402 includes an internal thread 1406 (female) that mates with an external thread 1408 (male) of the second member 1404. In another embodiment of the two part hollow interior design, FIG. 14B illustrates a drawing of the golf training aid device 400 with a lid 1410. In this example, the lid 1410 and opening of the body 402 have similar matching threads designs discuss in FIG. 14A. A slit 1412 formed in the lid 1410 may provide a means for fastening or unfastening the threaded lid 1410 from the body 402 using a tool such as a screwdriver or other large flat objects such as a coin. Other fastening techniques such as but not limited to clips, springs, pins, screws or any combination thereof may be used.

Figure 15A:
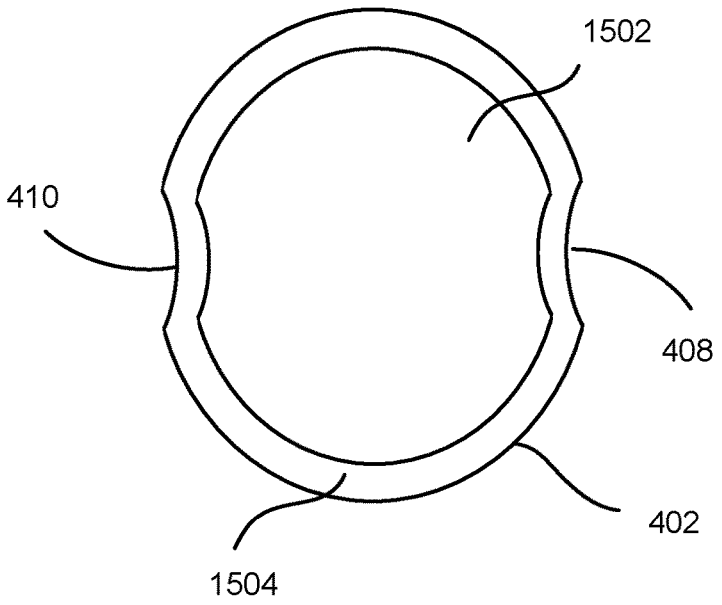
FIG. 15A illustrates a housing structure that defines the shape and appearance of the body of the golf training aid device, in accordance with an embodiment.
Figure 15B:
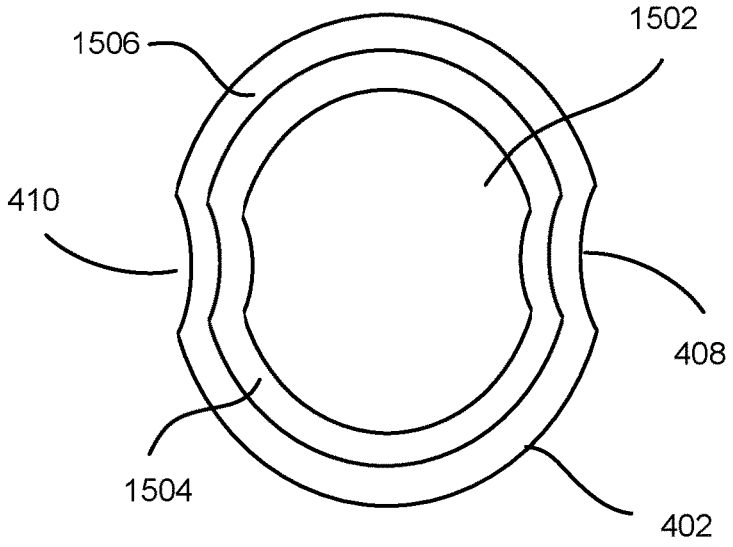
FIG. 15B illustrates a cover layer or skin applied to the surface of the golf training aid device, in accordance with an embodiment.

FIG. 15A and FIG. 15B illustrate embodiments of a cross-sectional view along the short circumference portion of the golf training aid device 400. In FIG. 15A, the body 402 of the golf training aid device 400 may include a housing structure 1504 that defines the shape and appearance of the body 402. As further illustrated in FIG. 15A, a hollow interior 1502 is defined by the inner portion of the housing structure 1504 of the body 402 of the golf training aid device 400. The housing structure 1504 may include materials such as but is not limited to plastics, foam, and wood. Injection molding processes, stereo lithography, 3D printing, laser or other molding or shaping techniques, for example, may be used to fabricate the golf training aid device 400 to form a lightweight yet durable part at high production output rates. In another aspect, a cover layer (or skin) 1506 made from a flexible membrane may be applied to the surface of the housing material 1504 of the body 402 of the golf training aid device 400 as shown in FIG. 15B. The flexible membrane 1506, in this example may be made from durable, soft, gel-like non-slip materials that provide grip and comfort to the golfer.

Figure 16:
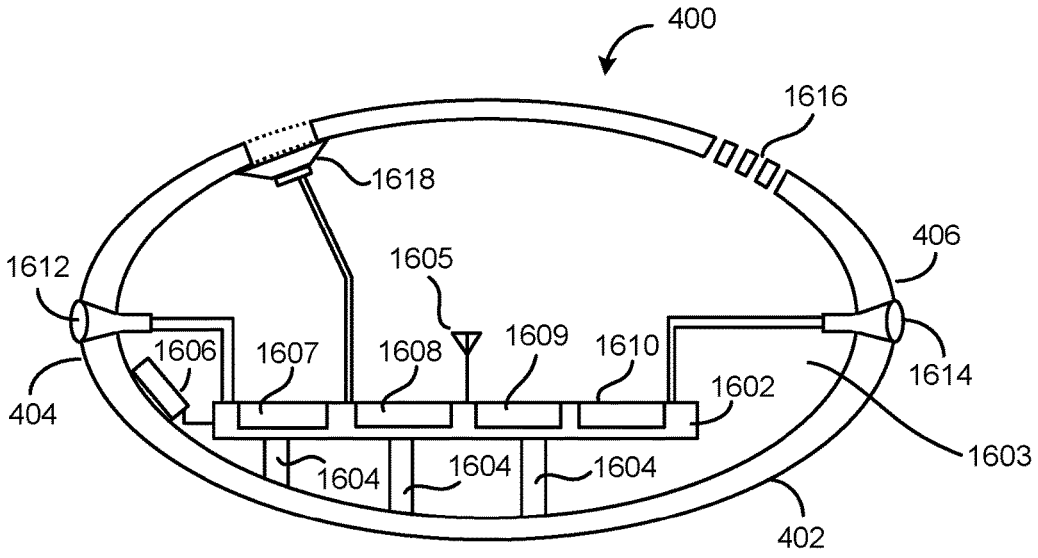
FIG. 16 illustrates a cross-sectional view along a long-circumference portion of the golf training aid device having built-in electronics and printed circuit board for providing an electronic reference and visual guide to the golfer, in accordance with an embodiment.

In accordance with another embodiment, FIG. 16 illustrates a cross-sectional view along the long circumference portion of the golf training aid device 400 having built-in electronics and printed circuit board for providing an electronic reference and visual guide to the golfer. In FIG. 16, for example, the golf training aid device 400 may include a circuit board 1602 such as a printed circuit board (PCB) mounted inside the interior side of the body 402, having hollow interior 1603 defined by the inner portion of the body 402. The circuit board 1602 may be mounted to the inner portion of the body 402 using two or more support members 1604. A power supply source 1606, such as a rechargeable battery, may be coupled to the circuit board 1602 supplying power thereto. The the circuit board 1602 may also include a controller 1608, computer data storage and memory 1609, an accelerometer circuitry 1610, and a laser driver circuitry 1610 for controlling various electronic reference and visual guide functions. In addition, an antenna 1605 may be coupled to a transceiver circuitry 1607 included on the circuit board 1602 for transmitting and receiving data to and from the circuit board 1602 to an external mobile computing device (not shown), such as a smartphone, tablet or laptop. The circuit board 1602 may be coupled to a spot detecting laser 1612 defined at the rear endpoint 404 side of the golf training aid device 400. Furthermore, the circuit board 1602 may be coupled to a targeting laser 1614 defined at the front endpoint 406 side of the golf training aid device 400. In application, the spot detecting laser 1612 may project a first visual reference indicator pointing at the golfer while the targeting laser 1614 may project a second reference indicator pointing at the target line. To prevent heat damage to the circuit board 1602, multiple exhaust vents 1616 may be defined in the body 402. An exhaust fan (not shown) may be attached to the interior side of the vents 1616 to further assist in cooling. Optionally, a speaker 1618 may be attached to interior side of the body 402 and coupled to the circuit board 1602. In one specific example, the golf training aid device 400 may be programmed by software or firmware to output an audio signal to the speaker 1618 for audio feedback and audible alerts to the golfer.

Figure 17A:
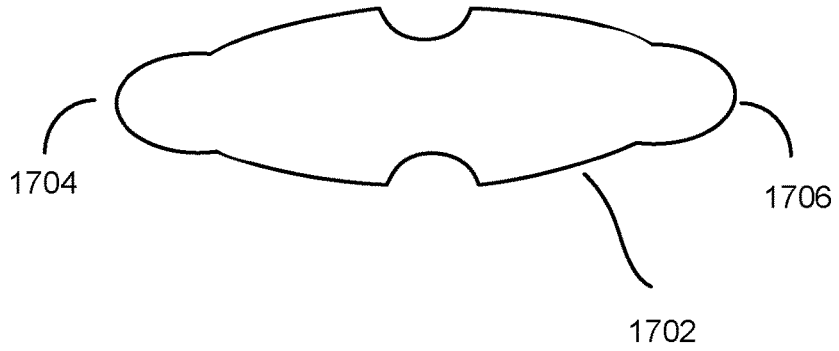
FIG. 17A illustrates the golf training aid device having an elliptically-shaped, narrow body of the golf training aid device, in accordance with an embodiment.
Figure 17B:
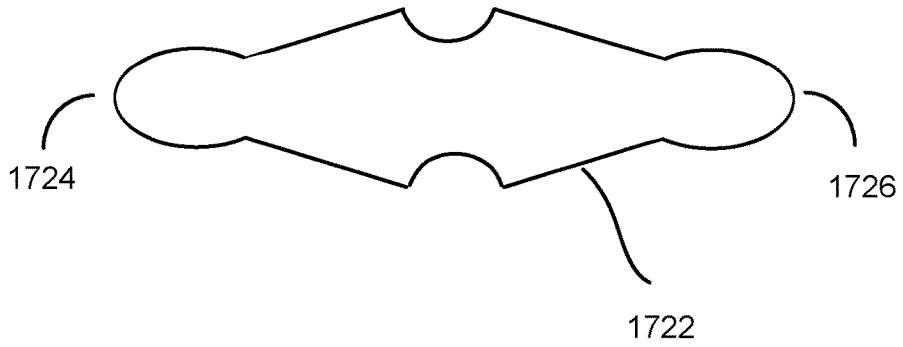
FIG. 17B illustrates the golf training aid having protruding rear and front curved-shaped endpoints defined at each end of a linear-shaped body, in accordance with an embodiment.

In accordance with yet another embodiment, FIG. 17A to FIG. 17B illustrate various shapes of the golf training aid device 400 as viewed from the top thereof. FIG. 17A, for example, presents a first shape of the golf training aid device 400 having an elliptically-shaped, narrow body 1702. In this example, the golf training aid device 400 may include protruding rear and front curved-shaped endpoints (1704, 1706) at each end of the narrow elliptically-shaped body 1702. In yet another example shown in FIG. 17B, the golf training aid device 400 may include protruding rear and front curved-shaped endpoints (1724, 1726) defined at each end of a linear-shaped body 1722. In other examples, other combinations of shapes, such as but not limited to polygons, curves or other geometric shapes, may define the rear and front endpoints and body of the golf training aid device 400.

Figure 18A:
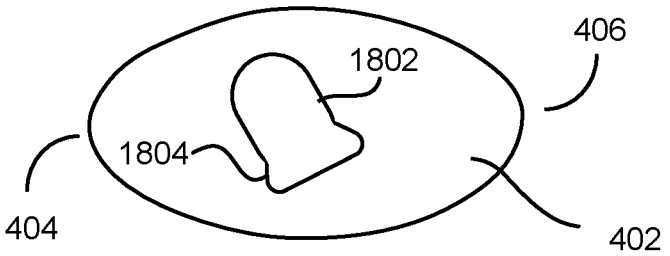
FIG. 18A illustrates an oval-shaped forearm swing guide of the golf training aid device having a flare-out region to fit a portion of the wrists of the golfer, in accordance with an embodiment.
Figure 18B:
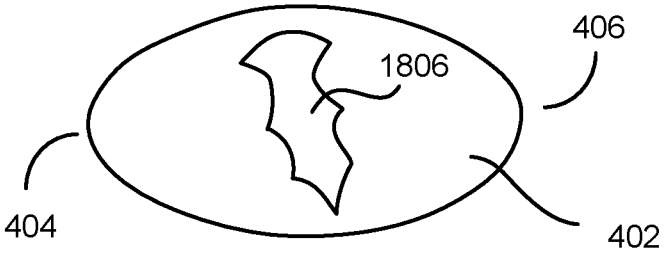
FIG. 18B illustrates the forearm swing guide of the golf training aid device having a thread-shaped or ribbed configuration, in accordance with an embodiment.

In another embodiment, the forearm swing guides may have shapes that improve contact and fit with the forearms of the golfer other than the oval shape cavity presented in FIG. 5A. In FIG. 18A, for example, an oval-shaped forearm swing guide 1802 may include a flare-out region 1804 to fit a portion of the wrists of the golfer, providing added stability and support to the golf training aid device 400. In this example, the flare-out region 1804 may be defined by a mold of the golfers forearm and a portion of the wrist. In yet another embodiment as shown in FIG. 18B, the forearm swing guide 1806 may be ribbed in order to provide a compression fit to the forearms of the golfer. The embodiments of the forearm swing guides (408 and 410) described hereinabove provide only a couple examples and not intended to limit the scope of other shapes, configuration and types of forearm swing guides defined on the golf training aid device 400.

Figure 19:
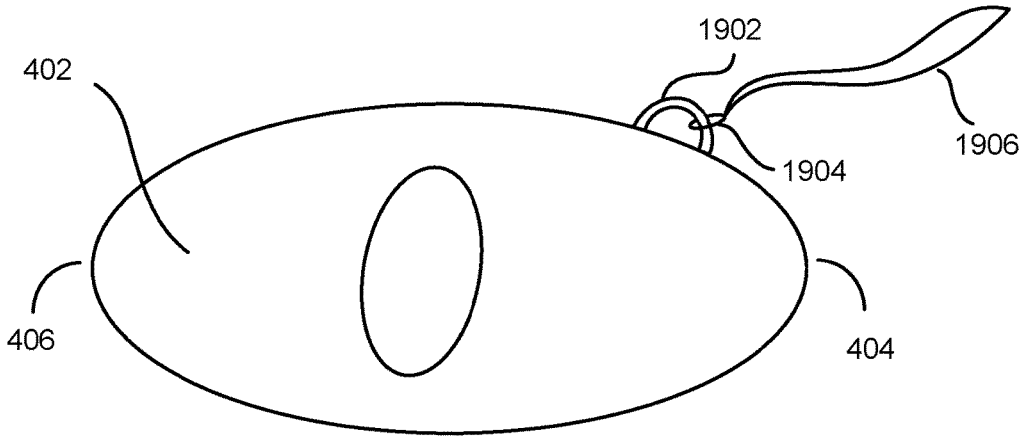
FIG. 19 illustrates a closed hook defined on one end of the outer exterior of the body of the golf training aid device, in accordance with an embodiment.

In FIG. 19, a closed hook 1902, such as an eyehook or D-hook, may be defined on one end of the outer exterior of the body 402 of the golf training aid device 400. The closed hook 1902 may be attached to a ring 1904 at one end of a strap (lanyard) 1906 while the open end of the strap 1906 is tethered to the wrist of the golfer to prevent the loss of the golf training aid device 400 during or after the golf swing.

In the remaining illustrations, various implementations of the golf training aid device 400 are presented to further demonstrate the suggested use thereof to achieve an effective golf swing impact. Moreover, these illustrations further demonstrate how the golf training aid device 400 may guide the arms and hands along the center and in front of the body, keeping the golfer along the proper swing plane and strike zone to achieve greater distance on the golf ball after strike.

Figure 20:
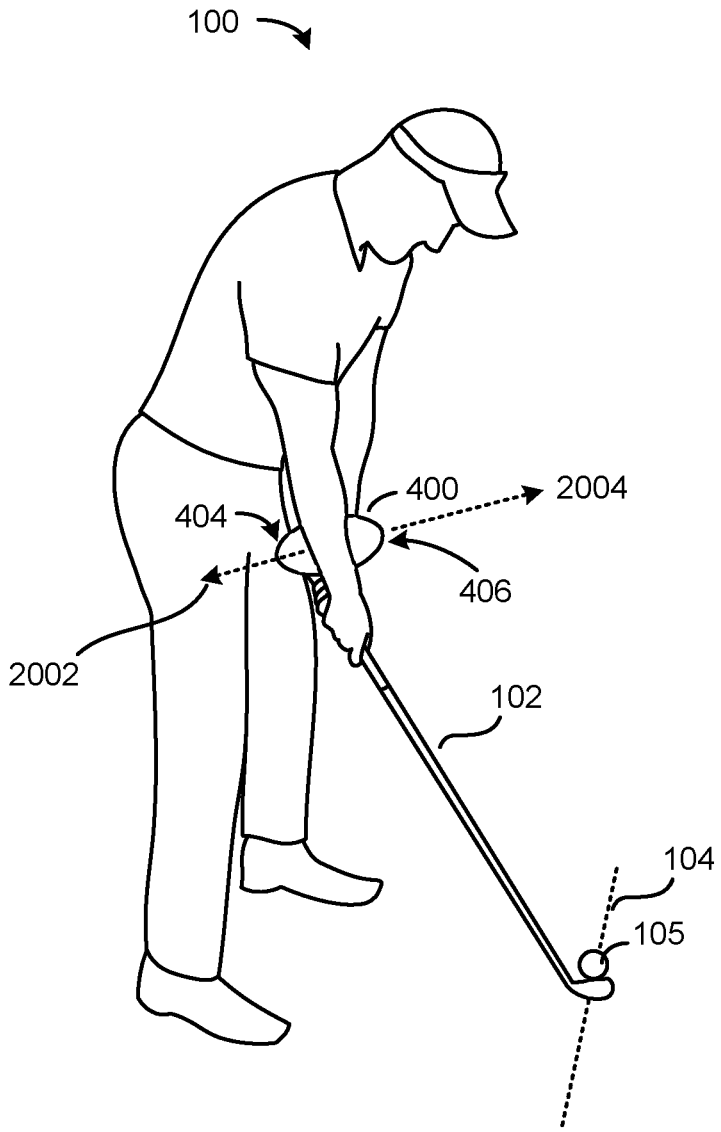
FIG. 20 illustrates an implementation of the golf training aid device as applied between by the forearms of the golfer at address position, in accordance with an embodiment.

FIG. 20, for example, illustrates the golf training aid device 400 applied between by the forearms of the golfer 100 at address position. Notice that at address position, the rear reference endpoint 404 side points directly at the golfer while the front reference endpoint 406 points away from the golfer. Arrows 2002 and 2004 show the preferred direction and orientation of the golf training aid device 400 relative to the forearms of the golfer 100, golf club 102 and target line 104. In this example, the form-fitted grooves of the forearm swing guides (408 and 410), hidden by the forearms and not visible in this drawing, may limit the forearms of the golfer as to keep the golf club 102 at a proper position so that clubface is maintained along the imaginary target line 104. The advantage of this limited movement of the forearms by the golf training aid device 400 is that it may prevent the golfer from bending or improperly rotating the forearms that may be attributed to misalignment and improper swing at impact. Hence, the limited movement of the forearms by the golf training aid device 400 promotes the proper position of the forearms, keeping the forearms straight and centered along the torso of the golfer at address position.

Figure 21:
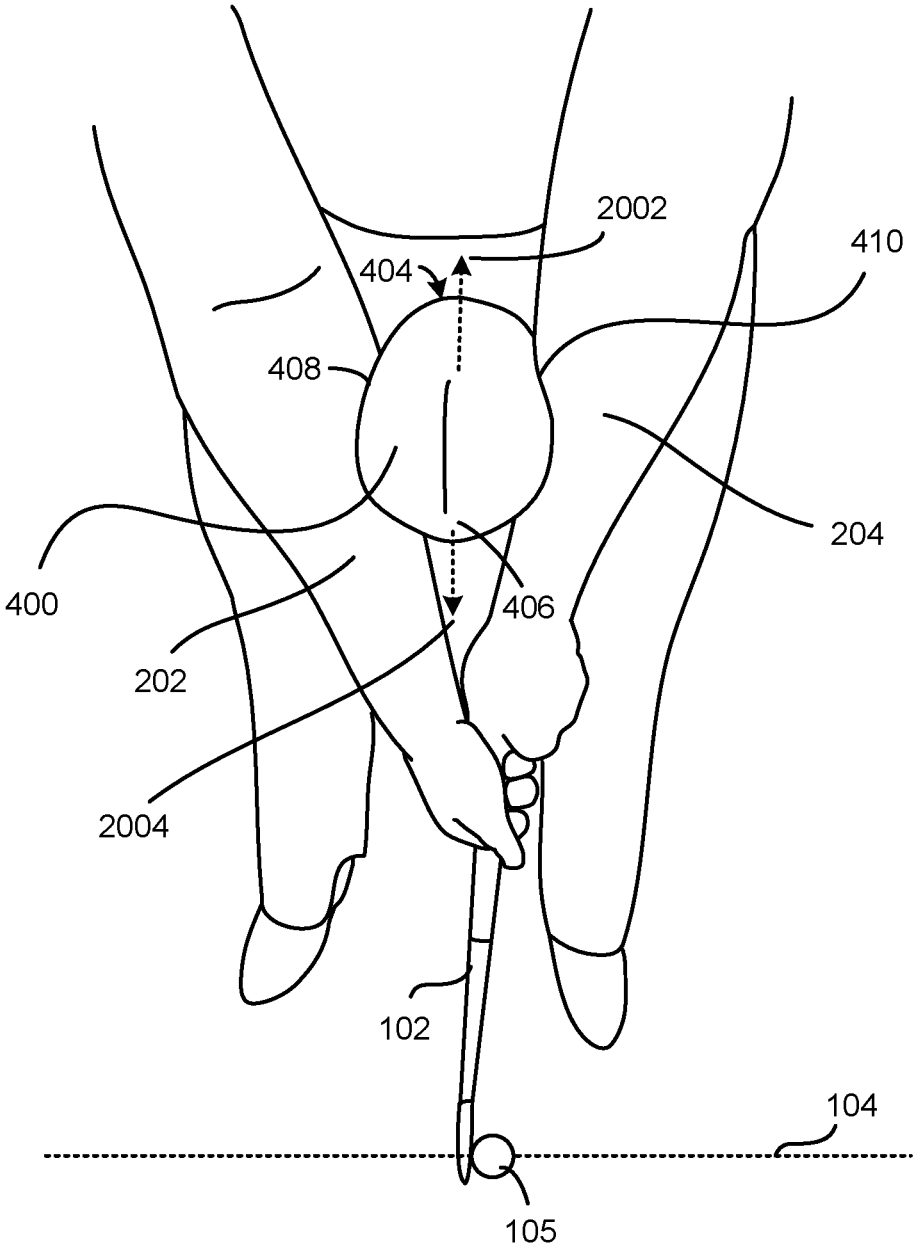
FIG. 21 illustrates a top front-facing view of the golfer applying the golf training aid device between the inner right and left forearms of the golfer to achieve the proper stance at address position, in accordance with an embodiment.

FIG. 21 illustrates a top front-facing view of the golfer 100 applying the golf training aid device 400 between the inner right and left forearms (202, 204, respectively) of the golfer 100 to achieve the proper stance at address position. Arrows 2002 and 2004 show the preferred direction and orientation of the golf training aid device 400 relative to the forearms (202, 204) of the golfer 100. Notice that at address position, the right and left forearm swing guides (408 and 410, respectively) are held by the right and left forearms (202, 204, respectively) so that the rear reference endpoint 404 side is pointed directly at the golfer while the front reference endpoint 406 points away from the golfer and at the target line 104. Also, note that the training device 400 generally keeps the forearms displaced at a fixed position so that both the right and left forearms (202, 204) are generally straight along the torso of the golfer 100 and rotated so that the club face of the golf club 102 is perpendicular to the target line 104.

Figure 22:
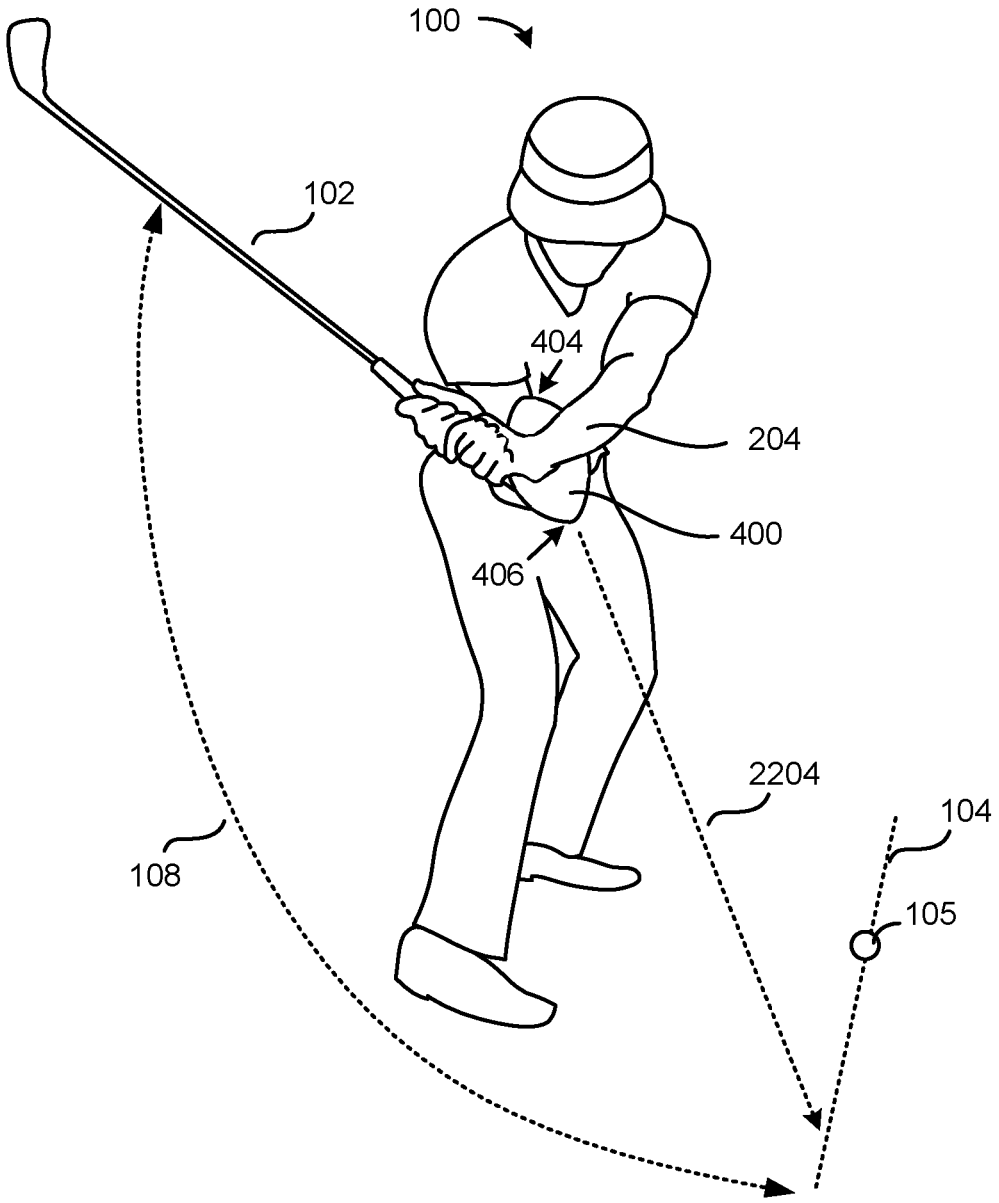
FIG. 22 illustrates the golf training aid device applied at an upswing, downswing, or backswing position by the golfer, in accordance with an embodiment.

FIG. 22 illustrates the golf training aid device 400 applied at an upswing/downswing (or backswing) position by the golfer 100. To achieve the proper swing along the swing plane 108, the front reference endpoint 406 provides the golfer 100 a visual guide to direct the golf training aid device 400 to the target line 104. By keeping the front reference endpoint 406 pointed at the target line 104 along path 2204 at backswing, the right and left forearm swing guides, having predetermined tilt angles, force the forearms (202, 204) of the golfer 100 to the proper swing plane 108 by encouraging the right arm and shoulder (for a right-handed golfer, for example) to eternally rotate.

At various swing positions, the golf training aid device 400 may be used as a guide to direct the golfer 100 to the correct swing plane path 108 by using the rear reference end point 404 as a visual reference to point at the center of the body of the golfer 100, preventing the golfer to take the golf club 102 on the outside position which is not a preferred position in practice. Moreover, as the golf club 102 is brought down, the front reference endpoint 406 may be used as a visual guide to point directly at the target line 104 to keep the golf swing along the correct swing plane path 108.

In one specific example and advantage, the golf training aid device 400 may promote and insures a one-piece take-away by discouraging the improper forms of hinging or rotating the forearms or wrist.

In another aspect and advantage, the golf training aid device 400 is intended to keep the arms and hands of the golfer along the center and in front of their body, providing a better strike and center hit for achieving greater distance on the golf ball.

In yet another advantage, the golf training aid device 400 may further teach the golfer 100 the proper swing plane technique of keeping the right arm and shoulder externally rotated to proper swing plane during the downswing. This is accomplished by pointing the front reference endpoint 406 toward the target line 104 on the downswing.

As used in the specification and the appended claims, the singular forms "a", "an", and "the" included plural referents unless the context clearly dictates otherwise.

All patents, patent applications, and other references cited herein are incorporated by reference in their entireties.

It is noted that the foregoing disclosure has been provided merely for the purpose of explanation and is in no way to be construed as limiting of the present invention. Although the present invention has been shown and described with respect to several preferred embodiments thereof, various changes, omissions, and additions to the form and detail thereof, may be made therein, without departing from the spirit and scope of the invention. It is understood that the words which have been used herein are words of description and illustration, rather than words of limitation. Changes may be made, within the purview of the appended claims, as presently stated and as amended, without departing from the scope and spirit of the present invention in its aspects.

Other embodiments and modifications of the present invention may occur to those of ordinary skill in the art in view of these teachings. Accordingly, the invention is to be limited only by the following claims which include all other such embodiments and modifications when viewed in conjunction with the above specifications and accompanying drawings.

What is claimed is what is described and illustrated, including:

1. A golf swing plane training aid device used by a golfer, the golf swing plane training aid device comprising:

an elongated spheroid body having a first end, a second end opposite to the first end, a mid-section situated between the first end and the second end, a first side, and a second side opposite to the first side;

a first protruding member defined on the first end of the elongated spheroid body, the first protruding member forming a first pointing structure on the first end;

a second protruding member defined on the second end of the elongated spheroid body, the second protruding member forming a second pointing structure on the second end;

a first forearm guide defined on the first side near the mid-section of the elongated spheroid body; and a second forearm guide defined on the second side near the mid-section of the elongated spheroid body.

2. The golf swing plane training aid device of claim 1, wherein in cross section each pointing structure is substantially parabolic in shape.

3. The golf swing plane training aid device of claim 1, wherein each pointing structure is narrower than the mid-section of the elongated spheroid body.

4. The golf swing plane training aid device of claim 1, wherein each forearm guide includes an oval shaped cavity formed near the mid-section of the elongated spheroid body.

5. The golf swing plane training aid device of claim 1, wherein the elongated spheroid body is defined by a housing structure having a hollow interior.

6. The golf swing plane training aid device of claim 1, wherein the first forearm guide is supported by a first inner portion of a right forearm of the golfer and the second forearm guide is supported by a second inner portion of a left forearm of the golfer.

7. The golf swing plane training aid device of claim 1, wherein each pointing structure provides the golfer a visual reference for directing a golf club along a predetermined swing path.

8. The golf swing plane training aid device of claim 1, wherein the first pointing structure is configured to point at the golfer and the second pointing structure is configured to point at a target line.

* * * * *